US012465141B2

(12) United States Patent
Mannem

(10) Patent No.: US 12,465,141 B2
(45) Date of Patent: Nov. 11, 2025

(54) MULTI-UTILITY TABLE

(71) Applicant: Janardhan Mannem, Riverview, FL (US)

(72) Inventor: Janardhan Mannem, Riverview, FL (US)

( * ) Notice: Subject to any disclaimer, the term of this patent is extended or adjusted under 35 U.S.C. 154(b) by 0 days.

(21) Appl. No.: 17/701,027

(22) Filed: Mar. 22, 2022

(65) Prior Publication Data

US 2023/0070831 A1 Mar. 9, 2023

Related U.S. Application Data

(60) Provisional application No. 63/240,892, filed on Sep. 4, 2021.

(51) Int. Cl.
*A47B 21/00* (2006.01)
*A47B 21/03* (2006.01)

(52) U.S. Cl.
CPC .. *A47B 21/0314* (2013.01); *A47B 2021/0335* (2013.01); *A47B 2200/0086* (2013.01)

(58) Field of Classification Search
CPC ..... A47B 21/0314; A47B 21/02; A47B 2021/0335; A47B 2200/0086; A47B 2200/0069; A47B 57/00; A47B 57/06; A47B 51/00; A47B 17/02; A47B 2200/0097; A47B 9/12; A47B 47/0083; A47B 83/045
USPC ... 108/26, 147, 136, 50.02, 50.01, 107, 109, 108/20; 211/187, 175, 103, 134; 312/29, 312/306, 25, 312
See application file for complete search history.

(56) References Cited

U.S. PATENT DOCUMENTS 4,790,611 A * 12/1988 Craner ..... F16M 11/046 312/29
6,230,907 B1 * 5/2001 Stuart ..... A47B 57/04 211/90.04
10,098,451 B2 * 10/2018 Keller ..... A47B 9/02
2003/0189021 A1 * 10/2003 Engel ..... A47B 46/005 211/175

(Continued)

FOREIGN PATENT DOCUMENTS

CN 206350592 * 7/2017
CN 107752452 A * 3/2018 ..... A47B 51/00

OTHER PUBLICATIONS

CN211092685 figure and abstract; Wu et al; Jul. 2020 (Year: 2020).*

(Continued)

*Primary Examiner* — Janet M Wilkens
(74) *Attorney, Agent, or Firm* — Barry Choobin; Patent 360

(57) ABSTRACT

A multi-utility table that includes a first platform a substantially a rectangular shape and four vertical members positioned at four corners of the first platform, wherein each vertical member of the four vertical members has a channel and the first platform is slidably mounted to the channels of the four vertical members. Each vertical member has an upper end and a lower end. An actuating member is operably coupled to the first platform for moving the first platform up and down along the channels. A second platform is mounted to the four vertical members near the lower end and below the first platform. A compartment is mounted to the four vertical members near the upper end.

10 Claims, 2 Drawing Sheets

(56) References Cited

U.S. PATENT DOCUMENTS

| | | | | |
|---|---|---|---|---|
| 2008/0017678 | A1* | 1/2008 | Anderson | A44C 5/003<br>224/236 |
| 2018/0132608 | A1* | 5/2018 | Benden | A47B 97/00 |
| 2020/0156868 | A1* | 5/2020 | Bidram | B65G 1/0492 |

OTHER PUBLICATIONS

CN206365623 figure and abstract; Liao et al; Aug. 2017 (Year: 2017).*
CN206350592 figure and abstract; Liao et al; Jul. 2017 (Year: 2017).*
CN107752452 English translation abstract and claim (Year: 2018).*

* cited by examiner

MULTI-UTILITY TABLE

CROSS-REFERENCE TO RELATED APPLICATIONS

This application claims priority from the U.S. provisional patent application Ser. No. 63/240,892, filed on Sep. 4, 2021, which is incorporated herein by reference in its entirety.

FIELD OF INVENTION

The present invention relates to a multi-utility table, and more particularly, the present invention relates to a multi-utility table with storage for organizing articles and incorporating utility accessories.

BACKGROUND

Tables are one of the most used pieces of furniture used for different purposes requiring placing the articles at a desired height above the ground. Study tables have a flat platform or tabletop above 25 to 35 inches above the ground supported by vertical members. Workstations, also known as desks or computer tables are similar to study tables but have added functionality of keeping a keyboard, CPU, printer, UPS, and the like. The known table designs including study tables and workstations are for limited use only.

A desire is always there for multi-utility tables. The rooms may have limited floor space, and it is desirable to include multiple accessories and functionality in a single piece of furniture. Thus, a need is appreciated from a multi-utility table that has utility accessories mounted to the table and is a space saver.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a multi-utility table incorporating features of a workstation, storage, bookshelf, and additionally incorporates multiple utility accessories.

It is another object of the present invention that the multi-utility table is a space saver.

It is still another object of the present invention that the multi-utility table is economical to manufacture.

It is yet another object of the present invention that the multi-utility table permits height adjustment.

It is a further object of the present invention that the multi-utility table can be used by children and adults.

It is still a further object of the present invention that the multi-utility table can be used for different purposes.

It is yet a further object of the present invention that the multi-utility table can be used to showcase articles.

In one aspect, disclosed is a multi-utility table that includes a first platform a substantially a rectangular shape; four vertical members positioned at four corners of the first platform, each vertical member of the four vertical members has a channel, wherein the first platform is slidably mounted to the channels of the four vertical members, each vertical member has an upper end and a lower end; an actuating member operably coupled to the first platform and configured to move the first platform up and down along the channels; and a second platform mounted to the four vertical members near the lower end and below the first platform.

In one implementation of the multi-utility table, the multi-utility table further comprises a compartment mounted to four vertical members near the upper end, wherein the compartment has an open front. A cover is pivotally coupled to the compartment for closing the open front. Alternatively, a drawer can be slidably mounted in the compartment. A trash tray can be slidably mounted below the second platform. A footrest can also be mounted to the second platform or the four vertical members near the lower end. A plurality of hooks can be included by mounting to one or more of the four vertical members such that the plurality of hooks can hung articles. A phone holder coupled near the first platform can also be provided. In one aspect, the phone holder can be coupled to the vertical member through a semi-rigid rod.

In one implementation, the multi-utility table further comprises four wheels coupled to the lower ends, wherein the multi-utility table can roll on the four wheels.

In one implementation, the actuating member comprises a reel mechanism having four cords, at least one pulley mounted to the upper end of each vertical member of the four vertical members, wherein the four cords extend from the reel mechanism and loop over the at least one pulley of each of the four vertical members, and a free end of the four cords fastened to the four corners of the first platform. The actuating member further comprises an electric motor configured to operate the reel mechanism. The actuating member further comprises a locking member configured to fixedly secure the first platform to the four vertical members at a desired height.

In one implementation, the multi-utility table further comprises a keyboard tray slidably mounted to a lower surface of the first platform, wherein the keyboard tray is configured to receive a keyboard. A cup-holder can also be mounted to a vertical member of the four vertical members or the first platform.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
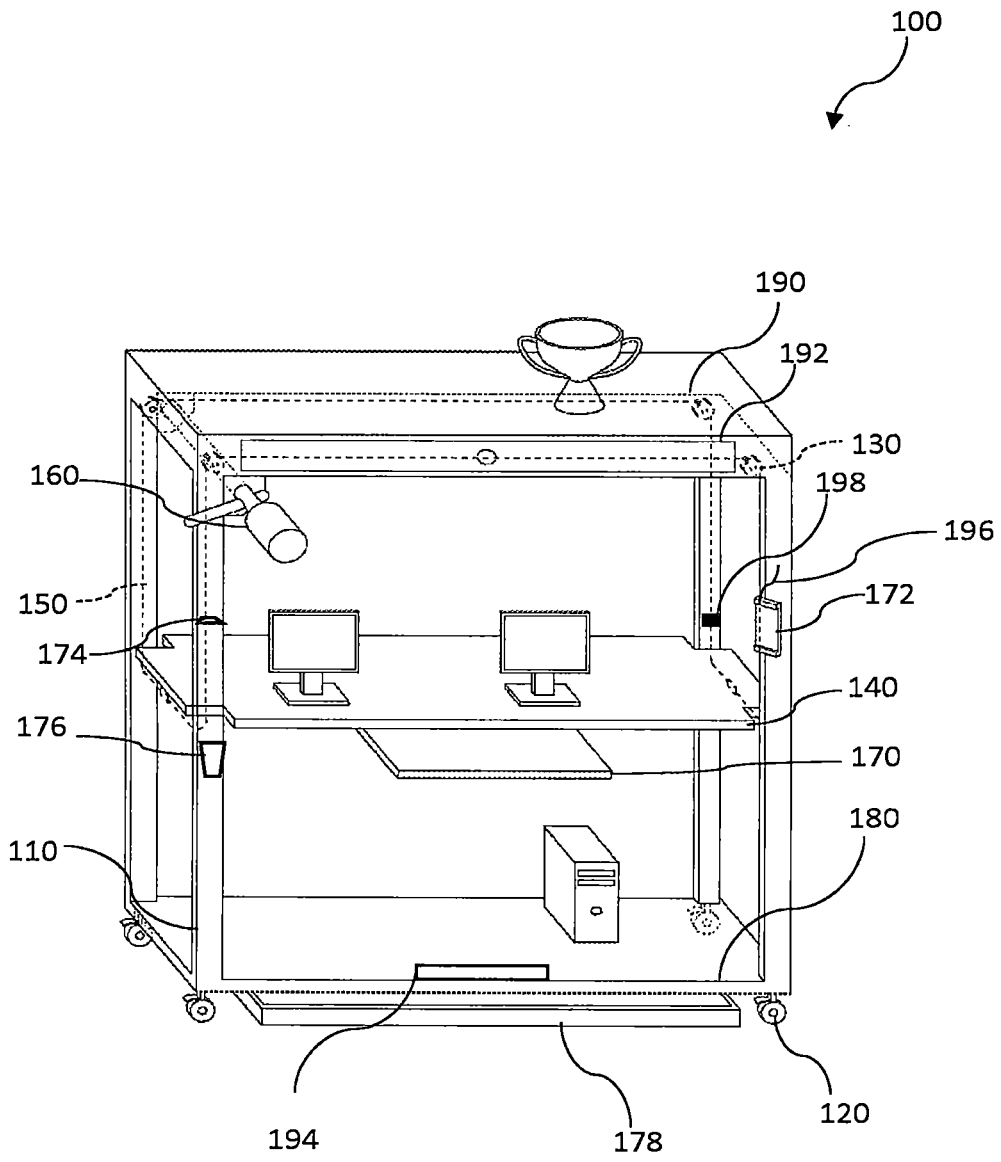
FIG. 1 is a perspective view of the multi-utility table, according to an exemplary embodiment of the present invention.

Disclosed is a multi-utility table that can be used as a workstation, storage, and display shelves, study table, and additionally incorporates different functionality for the convenience of the user and space-saving. Referring to FIG. 1, which discloses an exemplary embodiment of the multi-utility table having four vertical members 110 that can upstand on the floor. Each vertical member can have a lower end and an upper end. A wheel 120 is mounted on the lower end of each vertical member and a pulley 130 is mounted near the upper end. Each of the four vertical members has longitudinal channels, wherein a first platform 140 is mounted to the four channels of the four vertical members. The first platform 140 can move up and down along the four channels. An actuating member 160 can include a reel mechanism to which four cords 150 are reeled. The free ends of four cords 150 loops around the four pulleys 130 at the four vertical members 110. The actuating member 160 can be actuated to unwind the cord causing the first platform 140 to lower down along the four channels. The actuating member 160 can be actuated in opposite direction to wind the cord resulting in the lifting of the first platform 140. The height of the first platform 140 can be adjusted by the user by operating the actuating member 160. A handle (actuating member 160) can be seen in FIG. 1 that can be turned by a user to actuate the four pulleys to move the first platform 140 up and down. The first platform 140 can be positioned near the middle of the four vertical members at a height suitable for a workstation or study table. Additional locking members 198 can also be provided to secure the first platform 140 to the four vertical members 110. Suitable gliding members (not shown) can also be used to reduce any friction between the channels of the four vertical members 110 and the first platform 140. Such a mechanism of reducing friction is known to a skilled person and any such mechanism is within the scope of the present invention. Moreover, a different mechanism for adjusting the height of the first platform 140 in respect to the four vertical members 110 is also within the scope of the present invention. The first platform 140 can be used as a tabletop for study or computers. Different accessories, such as pen holders, light lamps, etc. can also be placed on the first platform 140. A keyboard tray 170 can also be seen in FIG. 1 mounted below the first platform 140 that could be drawn out and a keyboard of the computer can be placed on the keyboard tray 170. It is understood that the cord can be substituted with a chain, wire, rope, and the like without departing from the scope of the present invention.

A second platform 180 can be mounted near the lower ends of the four vertical members 110. The second platform 180 can be mounted to the four vertical members and can be used to place articles. The second platform 180 can be fixedly mounted to the four vertical members 110 and can support articles such as the CPU of a desktop workstation, UPS, printer, and the like. File organizers can also be placed on the second platform 180 removably or fixed. The second platform 180 can also support the four vertical members 110 and prevent them from collapsing. Additional horizontal members can also be used that extends between the opposite four vertical members 110 and support the first platform 140 and the second platform 180.

There can be provided some space below the second platform 180, between the second platform 180 and the floor, such as a trash tray 178 can be mounted below the second platform 180. The trash tray 178 can be slidably mounted to a frame which in turn can be fixedly coupled to the bottom of the second platform 180. The trash tray 178 can be withdrawn for putting the trash and then can be pushed to close the tray. The trash tray 178 can also be removed to dispose of the trash from the trash tray. Pedestals (not shown) can also be provided below the second platform 180 such as to support the multi-utility table 100 stably on the floor. It is understood that any other accessory that can fit below the second platform 180 can be incorporated without departing from the scope of the present invention.

The multi-utility table 100 can also include a compartment 190 mounted to the four vertical members 110 near the upper end. Compartment 190 can include an open front which can be closed by a pivoting door 192. Alternatively, a drawer can be slidably mounted into the compartment, such as the drawer can be pulled from and pushed into the compartment. The compartment or drawer can be used for storing multiple articles, such as books, files, and any article that can fit into the compartment or drawer. Also, the pivoting door can be omitted. On top of the compartment can be placed different articles for showcasing. For example, photo frames, trophies, speakers, and the like can be placed on top of compartment 190.

Hooks and stands can be mounted to the four vertical members 110 such as articles can be stowed in the hooks or stands. A pen holder 176 can be mounted to at least one vertical member, such as pens, pencils, and like can be placed in the pen holder 176. Hooks 174 can also be mounted on the vertical members, such as articles can be hung from the hooks 174. FIG. 1 also shows a phone holder 172 coupled to one of the four vertical members 110, such as phone or tablet computer can be mounted the phone holder 172. The phone holder can be coupled to the vertical member through a semi-rigid rod 196.

The disclosed table 100 can be made from any sturdy material such as wood or metal. The four vertical members 110 can be made from wood lumber or metal frame. Table 100 can move on four wheels 120 mounted to the lower ends of the four vertical members 110. The second platform 180 can also act as a footrest. Additionally, a separate footrest 194 can be provided that can be mounted to the second platform 180 or the vertical members 110. The footrest can be retracted and extended as and when desired. A user while sitting on a chair adjacent to table 100 and working can place his legs on the footrest, wherein the height of the footrest can be adjusted.

In one aspect, the first platform 140 can be unengaged from the channels and the vertical members such as the first platform 140 can swing back and forth. In one case, the first platform 140 can be moved up and down such as a person can have freedom for sitting on the bed, chair, and like while the height of the first platform 140 can be adjusted accordingly. Moreover, people of different ages i.e., children and adults can use the multi-utility table by adjusting the height of the table according to their heights or sitting positions. Thus, the disclosed table has multiple functionalities, features, and is versatile while saving floor space.

It is also envisioned that the height of the compartment can also be adjusted, or more than one compartment can be incorporated. A height-adjustable stool can also be provided and can be placed above the second platform. An electric motor can also be provided to lift and lower the first platform adjusting the height thereof. A cup holder can also be incorporated by mounting the cup holder to the first platform or nearby the first platform, such as a person can put the cup in the cup holder avoiding the accidental spilling of the contents of the cup on the first platform.

Figure 2:
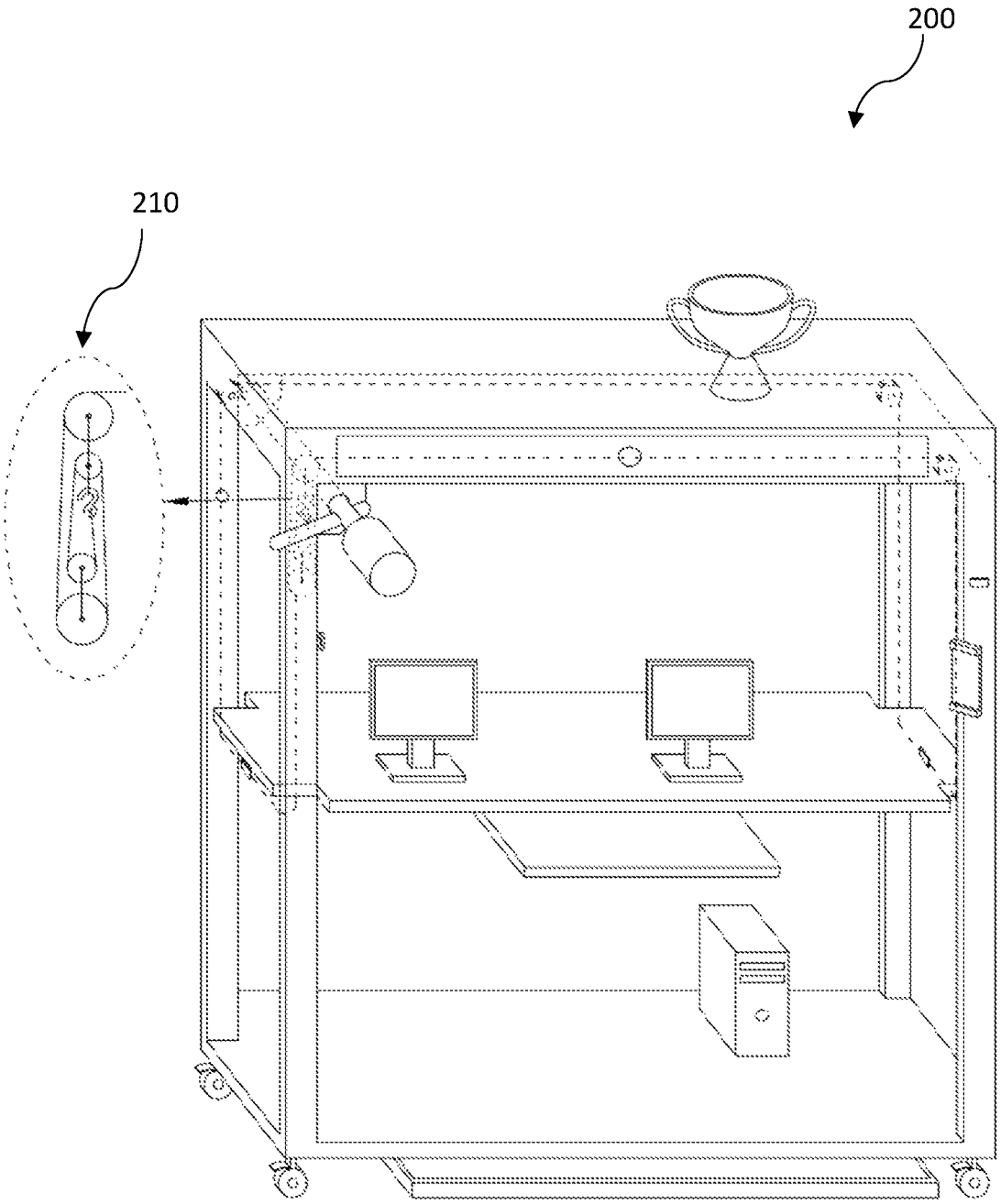
FIG. 2 shows another exemplary embodiment of the multi-utility table, according to an exemplary embodiment of the present invention.

Referring to FIG. 2 which shows another exemplary embodiment of the disclosed multi-utility table 200. The multi-utility table 200 is shown similar to the multi-utility table 100 shown in FIG. 1 and hence not described further here. FIG. 2 illustrates the pulley system 210 that can be incorporated into the disclosed multi-utility table 200. The pulley system 210 can include four pulleys and a rope wraps around the four pulley to decrease the efforts for lifting the platform of the multi-utility table 200. The pulley system 210 can also include suitable handle that can be grabbed by hand to pull or release the rope running around the pulleys. The pulley can be rollers, ball bearing, swivel wheel, and the like known to a skilled person for reducing the resistance to which the cord is subjected to while pulling or releasing the cord.

In certain implementations, the disclosed multi-utility table can be manufactured in a workshop as a complete unit, and the complete unit can be transported. Alternatively, the disclosed multi-utility table can be manufactured in units at the workshop that can be packed and transported. The units can be assembled on site using predefined instructions. The disclosed multi-utility table can also be manufactured as ready-to-assemble furniture, also known as knock-down furniture, flat pack furniture, or kit furniture. The kit can be assembled on site using predefined instructions.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A multi-utility table comprising:

a first platform of a substantially a rectangular shape;

four vertical members positioned at four corners of the first platform, each vertical member of the four vertical members has a channel, wherein the first platform is slidably mounted to the channels of the four vertical members, each vertical member of the four vertical members has an upper end and a lower end;

an actuating member operably coupled to the first platform and configured to move the first platform up and down along the channels, wherein the actuating member comprises:

a reel mechanism having four cords, and at least one pulley mounted to the upper end of each vertical member of the four vertical members, wherein the four cords extend from the reel mechanism and loop over the at least one pulley of each of the four vertical members, and a free end of the four cords fastened to the four corners of the first platform;

a second platform mounted to the four vertical members near the lower end and below the first platform;

a compartment mounted to four vertical members near the upper end, wherein the compartment has an open front;

a trash tray slidably mounted below the second platform;

a footrest mounted to the second platform or the four vertical members near the lower end;

a plurality of hooks mounted to one or more vertical members of the four vertical members, wherein the plurality of hooks is configured to hung articles;

a phone holder coupled to a vertical member of the four vertical members, wherein the phone holder is coupled near the first platform; and four wheels coupled to the lower end of each of the four vertical members, wherein the multi-utility table rolls on the four wheels.

2. The multi-utility table according to claim 1, wherein a cover is pivotally coupled to the compartment for closing the open front.

3. The multi-utility table according to claim 1, wherein the phone holder is coupled to the vertical member through a semi-rigid rod.

4. The multi-utility table according to claim 1, wherein the actuating member further comprises an electric motor configured to operate the reel mechanism.

5. The multi-utility table according to claim 4, wherein actuating member further comprises a locking member configured to fixedly secure the first platform to the four vertical members at a desired height.

6. The multi-utility table according to claim 5, wherein the multi-utility table further comprises a keyboard tray slidably mounted to a lower surface of the first platform, wherein the keyboard tray is configured to receive a keyboard.

7. The multi-utility table according to claim 6, wherein the multi-utility table further comprises a cup-holder mounted to a vertical member of the four vertical members or the first platform.

8. A multi-utility table comprising:

a first platform of a substantially a rectangular shape;

four vertical members positioned at four corners of the first platform, each vertical member of the four vertical members has a channel, wherein the first platform is slidably mounted to the channels of the four vertical members, each vertical member of the four vertical members has an upper end and a lower end;

an actuating member operably coupled to the first platform and configured to move the first platform up and down along the channels, wherein the actuating member comprises:

a reel mechanism having four cords, and at least one pulley mounted to the upper end of each vertical member of the four vertical members, wherein the four cords extend from the reel mechanism and loop over the at least one pulley of each of the four vertical members, and a free end of the four cords fastened to the four corners of the first platform; and a second platform mounted to the four vertical members near the lower end and below the first platform.

9. The multi-utility table according to claim 8, wherein the actuating member further comprises an electric motor configured to operate the reel mechanism.

10. The multi-utility table according to claim 9, wherein actuating member further comprises a locking member configured to fixedly secure the first platform to the four vertical members at a desired height.

* * * * *